United States Patent [19]

Yost

[11] Patent Number: 4,967,526

[45] Date of Patent: Nov. 6, 1990

[54] BUILDING STRUCTURES WITH PREASSEMBLED, SIMULATED, EXTERNAL LOG CABIN, CORNER JOINT UNITS FITTING WITH HORIZONTALLY EXTENDING VERTICALLY JUXTAPOSED SIDING MEMBERS

[76] Inventor: Timothy Yost, 413 12th St., Mio, Mich. 48647

[21] Appl. No.: 468,242

[22] Filed: Jan. 22, 1990

[51] Int. Cl.[5] ..... E04B 1/10

[52] U.S. Cl. ..... 52/233

[58] Field of Search ..... 52/233, 285, 747; 446/106

[56] References Cited

U.S. PATENT DOCUMENTS

| | | | |
|---|---|---|---|
| 1,654,120 | 12/1927 | Ewing | 52/233 |
| 4,034,527 | 7/1977 | Jalasjaa | 52/233 |
| 4,056,906 | 11/1977 | Elfsrom | 52/233 |
| 4,096,674 | 6/1978 | Kollar | 52/233 |
| 4,320,610 | 3/1982 | Rupp | 52/233 |
| 4,592,182 | 6/1986 | Fesler | 52/233 |
| 4,640,069 | 2/1987 | Felser | 52/233 |
| 4,688,362 | 8/1987 | Pedersen | 52/233 |
| 4,823,528 | 4/1989 | Faw | 52/233 |
| 4,878,328 | 11/1989 | Berge | 52/233 |

*Primary Examiner*—John E. Murtagh

*Attorney, Agent, or Firm*—Learman & McCulloch

[57] ABSTRACT

A building structure has simulated log cabin, corner joint units comprising a first series of vertically spaced, parallel, simulated log end blocks and a second series of vertically spaced simulated log end blocks extending perpendicularly to said first series of blocks, with the inner ends of said first and second series of blocks, with the inner ends of said first and second series of end blocks being intermeshed. The blocks of each series have their inner ends configured to form a notch with intersecting perpendicular walls for receiving and abutting the perpendicular faces of the corner framing of the structure, with the notches defining tenons on one side of each block extending along and abutting one face of the corner framing. The tenons formed on one series of blocks projecting perpendicularly to the tenons formed on the other series of blocks. Fasteners extend through the blocks to secure them in position as simulated extensions of the siding walls of the structure.

17 Claims, 2 Drawing Sheets

BUILDING STRUCTURES WITH PREASSEMBLED, SIMULATED, EXTERNAL LOG CABIN, CORNER JOINT UNITS FITTING WITH HORIZONTALLY EXTENDING VERTICALLY JUXTAPOSED SIDING MEMBERS

BACKGROUND OF THE INVENTION

The invention to be more particularly described relates generally to the construction of buildings having a "log cabin" appearance, and particularly to a preassembled corner joint unit which interfits with horizontally extending, vertically juxtaposed siding members forming perpendicularly extending walls at the corners of the structure.

In recent years, home owners in many communities have popularized the construction of log home type buildings in which the ends of the logs at the corner protrude alternately in "pioneer" fashion. Various patents have been granted which have a relationship to structures having a "log cabin" appearance, including the following:

| | |
|---|---|
| 4,056,906 Elfstrom | 4,640,069 Felser |
| 4,320,610 Rupp | 4,688,362 Pedersen et al |
| 4,592,182 Felser | 4,823,528 Faw |
| 4,627,204 Smith | |

U.S. Pat. No. 4,823,528, as an example, is directed to a more traditional log cabin structure in which the ends of the logs are notched to interfit and the logs are then bolted together by vertical rods, with spacer members between the logs simulating mortar joints.

U.S. Pat. No. 4,320,610 provides a preassembled corner block assembly in which siding strips having convex exterior faces are coextensive with blocks forming the corner assembly which do not intermesh.

U.S. Pat. No. 4,640,069 provides a unit requiring a departure from conventional corner forming practice.

One of the prime objects of the present invention is to provide a preassembled, simulated "log cabin" corner joint unit which will interfit with conventional siding members in a manner so that the siding members need not be nailed to the projecting faces of the blocks forming the joint.

Another object of the invention is to provide a corner joint providing a simulated "log cabin" corner which can be preassembled off-site and fitted to the corner framing.

Still another object of the invention is to provide a preassembled corner joint which enhances the appearance of building structures which are constructed of horizontally extending, vertically juxtaposed siding, and which can be readily installed without requiring an inordinate amount of labor by workmen who need not be of great skill.

SUMMARY OF THE INVENTION

The present invention is concerned with a building structure utilizing a novel, simulated "log cabin" corner joint, which readily interfits with conventional wood siding to form a building having a "log cabin" appearance. The invention is also concerned with a method of installing a joint of this character which is preassembled at a factory, or other site, and then simply applied to the corner wall framing of a building structure in a manner to fit the conventional siding walls of the structure.

The invention provides a building with corners of the type indicated which are modularly assembled at a factory or the like, with the attendant ease and economic advantages of preassembly, while still retaining the advantages of conventional framing and siding construction. The construction has numerous advantages over the prior art structures.

DESCRIPTION OF THE PREFERRED EMBODIMENTS

Figure 1:
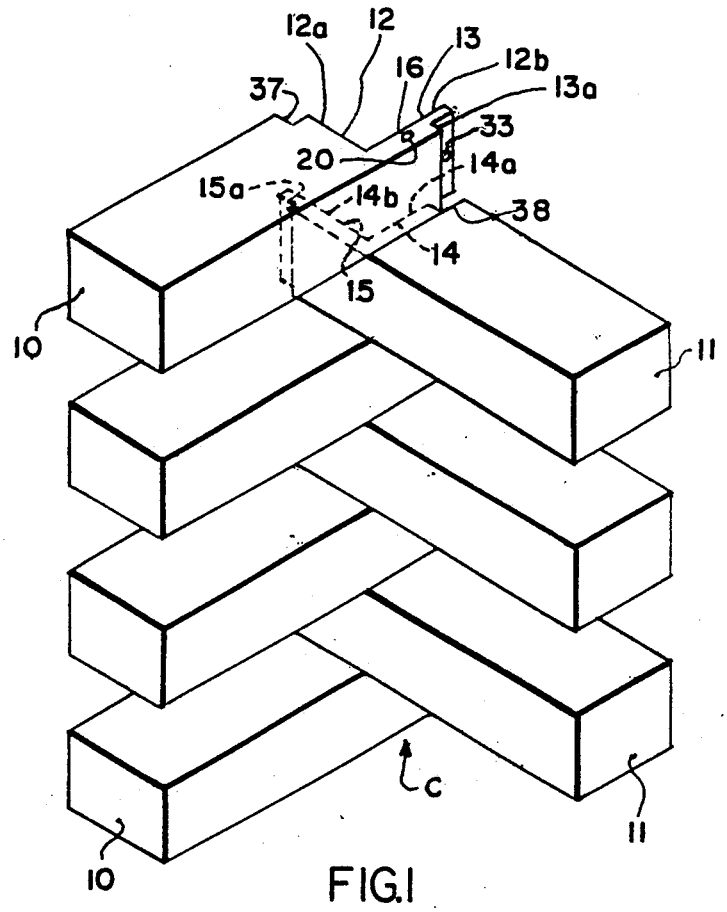
FIG. 1 is a perspective, elevational, view of the preassembled corner joint only.

Referring now more particularly to the accompanying drawings, the corner joint disclosed in FIG. 1 may be prefabricated as a separate unit at the factory for attachment to the corner of a building of predetermined height. As FIG. 1 indicates, the corner structure, generally designated C, includes a series of vertically spaced blocks 10, vertically intermeshing with vertically spaced blocks 11 which extend perpendicularly thereto. Each block 10 is recessed at its inner end, as at 12, to provide faces **12*a* and 12*b* which extend perpendicularly, one to the other. The recessing of the ends of blocks 10 provides projecting tenons 13 at each inner end of a block 10**.

Similarly, blocks 11 are recessed in an identical manner, as at 14, to provide like perpendicularly extending faces **14*a* and 14*b*, and the extending tenons 15. When the blocks 10 and 11 are in preassembled relation as shown in FIG. 1, faces 12*a* and 14*b* are in vertical alignment, as are the faces 12*b* and 14*a*. Aligned vertical bores 16 are provided in each of the tenons 13, generally intermediate their lengths, and similar vertically aligned bores 17 (FIG. 3), are provided in the tenons 15**.

Provided in the inner ends of blocks 11, to vertically align with the openings 16, are passages 18, while passages 19 are provided in the inner ends of blocks 10 to align with the passages 17. The aligned passages 16 and 18 accommodate rods 20 which are threaded at their upper and lower ends, and which receive nut and washer assemblies 21 at both their upper and lower ends. Similarly, the aligned passages 17 and 19 receive rods 22, which are threaded at their upper and lower ends, and similarly receive nut and washer assemblies 23. When the nut and washer assemblies 21 and 23 are tightened down, the blocks 10 and 11 are relatively compressed, and the preassembled corner is held in this preassembled position in readiness to be applied to the corner of a building structure.

Figure 2:
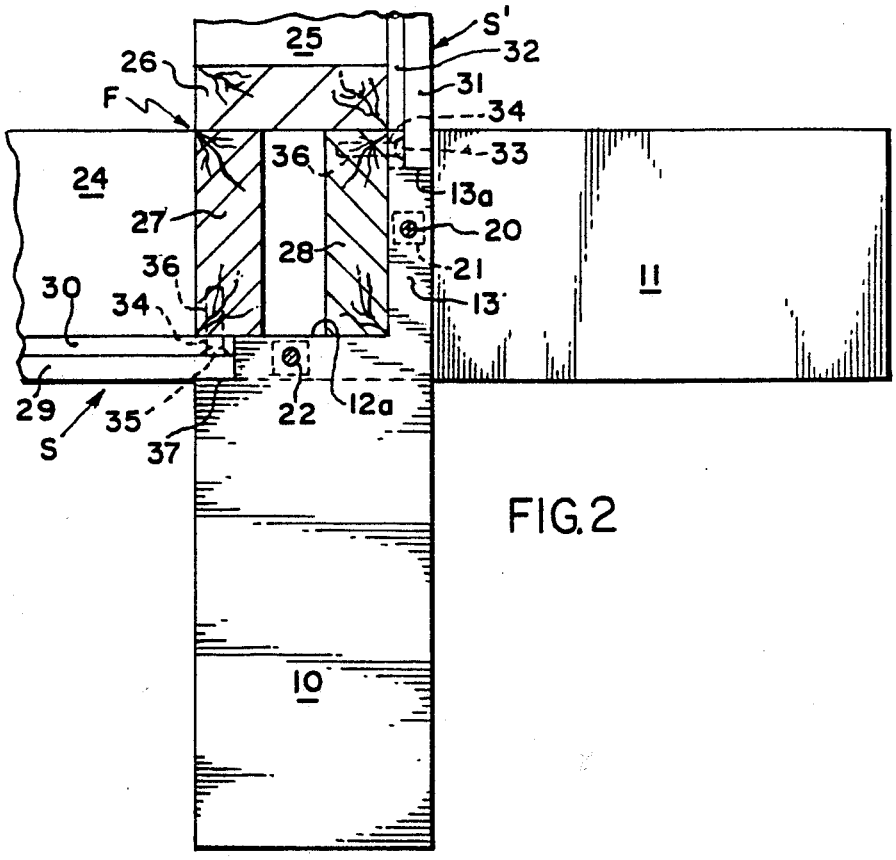
FIG. 2 is an enlarged sectional, fragmentary, plan view, illustrating a preferred embodiment of the invention and taken on the line 2—2 of FIG. 3.
Figure 3:
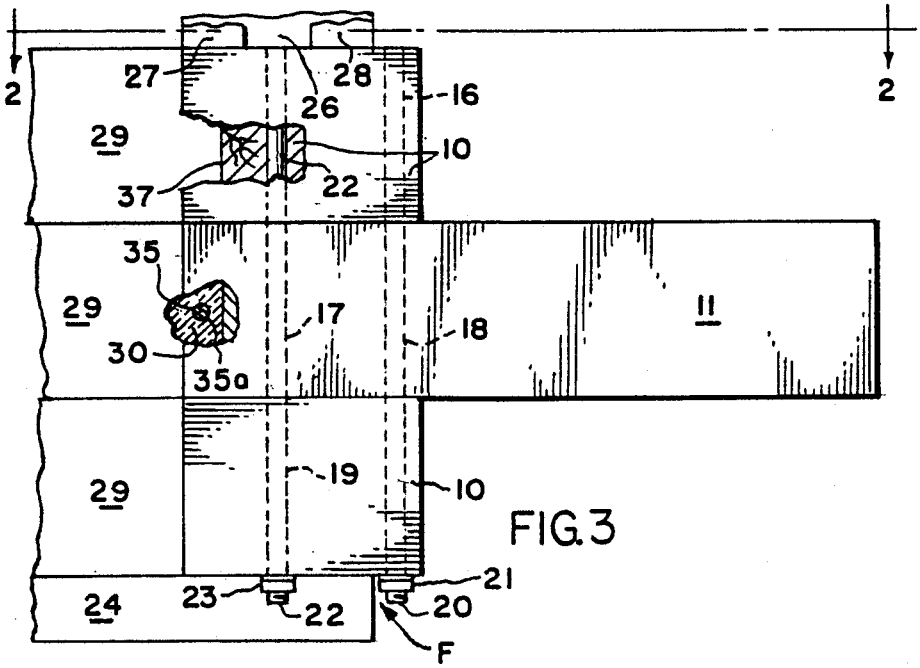
FIG. 3 is a fragmentary, elevational view of the corner joint secured in position at a building structure corner.

FIGS. 2 and 3 more particularly illustrate the elements of the building structure to which the preassembled corners may be applied, and include foundations or the like which may consist of bottom plates 24 and 25, extending at right angles one to the other at each corner of the building structure. Vertically extending framing or studding, identified by the stud members 26, 27 and 28, which are nailed together in the usual manner to form a conventional corner-framing unit, generally designated F, are provided at each corner of the structure secured to plates 24 and 25. It is to these framing units F, of normal building construction, that vertically juxtaposed, horizontal siding members 29 are nailed over plywood or insulating foam 30 to form one side wall of the structure S. A second side wall S' is formed by siding members 31 nailed over plywood or insulating foam 32. The siding strips 29 and 31 are, in the usual manner, nailed to the corner framing F and additionally to the horizontally spaced vertical studs (not shown) which extend along the side walls S and S' in spaced apart relation.

The corner joint unit may be secured in place by screws 33, extending through openings 34 in the tenons 13, and screws 35, extending through openings 35*a* in the tenons 15, into openings 36 in the corner framing F, in a like manner.

In a preferred embodiment of the invention the face 12*a* of each of the blocks 10 is dado-notched as at 37, to receive the ends of the siding and backer members 30 and 29 in the same course forming side wall S, and the ends of the faces 14*a* of blocks 11 are similarly dado-notched as at 38 to receive the ends of the siding and backer members 31 and 32 in the same course. In addition, the ends of tenons 13 are notched as at 13*a* to receive the ends of the siding members 31 in the same course and the ends of tenons 14*b* are similarly notched, as at 39, to receive the ends of the siding members 29 in the same course.

When installing the structure described, the preassembled corner units are secured to the corner framing units F prior to the time that the siding walls S and S' are completed. When the siding walls S and S' are later completed, the ends of the siding pieces 29 and 31 and members 30 and 32 will be cut to fit the notches 37–38 and 13*a*–14*a*.

In another embodiment, the notches 37–38 and 13*a*–14*a* may be eliminated, with the result that the members 29 and 30 forming wall S, simply abut and are not received by the blocks 10. Similarly, the members 31 and 32, forming siding wall S', will simply abut and not be received by the blocks 11. When this construction is utilized, the siding walls S and S' can be installed first of all, and the preassembled corner joint 10 then simply placed in position against the framing unit F and secured in position via screws 33 and 35.

The disclosure is representative of preferred embodiments of the invention, but is intended to be illustrative rather than definitive thereof. The invention is defined in the claims.

What is claimed is:

1. A building structure including preassembled simulated log cabin, corner joint units fitting with horizontally extending, vertically juxtaposed siding members forming perpendicularly extending first and second walls, secured to vertically extending corner wall framing erected on the building foundation at corners of the structure and having vertically extending faces at right angles; each of said corner units comprising:

a. a first series of relatively short, vertically spaced, parallel, simulated log end blocks projecting horizontally beyond the siding members of said first wall and said corner wall framing, and defining vertically spaced receiving spaces between them;

b. a second series of relatively short, vertically spaced, parallel, simulated log end blocks projecting horizontally at right angles to said first series of end blocks beyond the siding members forming said second wall, inner ends of the second series of log end blocks being received in said receiving spaces to intermesh with the inner ends of said first series of blocks;

c. the blocks of said first and second series of blocks each having its inner ends configured to form a notch with intersecting perpendicular walls for receiving and abutting the corner framing faces, said notch providing transverse faces at right angles to the direction of projection of said blocks for receiving one face of a corner framing in abutting relationship, and further providing tenons on one side of each block overlying the other face of said corner framing, with the tenons of one series of blocks projecting perpendicularly relative to the tenons of said other series of blocks; and d. vertically extending fastener means extending up through both series of blocks to secure said blocks in preassembled relation.

2. The structure of claim 1 wherein vertically aligned passages are provided in each series of blocks and said fastener means comprises vertically extending rods extending up through said openings, and means carried by said rods for exerting a compressive force clamping said series of blocks in assembled relation.

3. The structure of claim 2 wherein said rods have threaded ends and said means for exerting a compressive force include nuts threaded thereon.

4. The structure of claim 2 wherein said passages are provided in said tenons, and the inner ends of the blocks in the other series of blocks underlying said tenons.

5. The structure of claim 1 wherein said tenons are notched at their ends to receive the ends of the siding members forming said one wall.

6. The structure of claim 5 wherein said blocks are also notched to receive siding members forming the other perpendicularly disposed wall.

7. In a preassembled, simulated log cabin corner unit for fitting with the vertically extending, relatively perpendicularly disposed faces of a building's corner framing, and fitting with the building's horizontally extending siding members at a corner of a building; said corner unit comprising:

a. a first series of relatively short, vertically spaced, parallel, simulated log end blocks;

b. a second series of relatively short, vertically spaced, parallel, simulated log end blocks, projecting horizontally at right angles to said first series of end blocks, with their ends received in spaces between said first series of blocks to intermesh therewith;

c. the blocks of said first and second series of blocks each having ends configured to form a notch with intersecting perpendicular walls for receiving and abutting the corner framing faces; said notch in each block providing transverse faces at right angles to the direction of projection of the blocks for receiving one face of a corner framing in abutting relationship, and further providing tenons on one side of each block overlying the other face of the corner framing, with the tenons of one series of blocks projecting perpendicularly relative to the tenons of the other series of blocks; and d. vertically extending fastener means extending up through both series of blocks to clamp the blocks of said series of blocks in intermeshed, preassembled relation.

8. The structure defined in claim 7 wherein vertically aligned passages are provided in each series of blocks and said fastener means includes vertically extending rods having threaded ends, extending up through said openings; and nut means threaded on the ends of said rods which can be tightened to exert a compressive force on said intermeshed series of blocks.

9. The structure of claim 8 wherein said passages are provided in said tenons, and the portions of the blocks in the other series of blocks underlying said tenons.

10. The structure defined in claim 9 wherein said tenons are notched at their ends to receive and interfit with the ends of siding members forming one wall, and other portions of said blocks are also notched to receive and interfit with siding members forming the other perpendicularly disposed wall.

11. A method of constructing a building structure comprising simulated log cabin corner joint units, fitting with horizontally extending, vertically juxtaposed siding members forming first and second side walls secured to vertically extending corner wall framing which is erected on the building foundation at the corners of the structure, the joints including a first series of relatively short, vertically spaced, parallel simulated log end blocks projecting horizontally beyond the siding members of said first wall, and defining vertically spaced receiving spaces between them; a second series of relatively short, vertically spaced, parallel, simulated log end blocks projecting horizontally at right angles to said first series of end blocks beyond the siding members forming said second wall; the second series of said blocks being received in said receiving spaces to intermesh with the first series of blocks; the first and second series of blocks each having ends configured to form a notch with intersecting perpendicular walls for receiving and abutting the corner framing faces; each notch providing transverse faces at right angles to the direction of projection of said blocks receiving one face of a corner framing in abutting relation, and further providing tenons on one side of each block overlying the other face of said corner framing, with the tenons of one series of blocks projecting perpendicularly relative to the tenons of said other series of blocks; and vertically extending fastener means extending up through both series of blocks to secure said blocks in preassembled relation; the steps of:

a. assembling said horizontally extending log end blocks having the vertically aligned openings in an intermeshed juxtaposed relation in which the vertically adjacent blocks extend at right angles one to the other, while retaining them via rods extended through said openings;

b. tightening fastening means on the rods to clamp the intermeshed blocks of each series of blocks in intermeshed relation;

c. applying said joint unit to said corner framing with the tenons on vertically adjacent blocks overlying said corner framing and extending perpendicularly to one another; and d. securing said corner joint unit in place by attaching it to said corner framing.

12. The method of claim 11 wherein the tenons on said blocks are prenotched and vertically alternate siding members are placed in said notches.

13. The method of claim 12 wherein walls of said blocks generally opposite said tenons are prenotched to form recesses and vertically alternate siding members are placed in said recesses and secured in position.

14. A building structure including simulated log cabin, corner joint units for horizontally extending, vertically juxtaposed siding members forming first and second walls secured to the perpendicular vertically extending faces of vertically extending corner wall framing which is erected on the building foundation at the corners of the structure, said corner units comprising:

a. a first series of relatively short, vertically spaced, parallel, simulated log end blocks projecting horizontally beyond the siding members of said first wall and said corner wall framing, and defining vertically spaced receiving spaces between them;

b. a second series of relatively short, vertically spaced, parallel, simulated log end blocks projecting horizontally at right angles to the end blocks of said first series beyond the siding members forming said second wall, the ends of said second series of end blocks being received in said receiving spaces to intermesh therewith;

c. said first and second series of blocks each having ends configured to form a notch with intersecting perpendicular walls for receiving and abutting the perpendicular corner framing faces; each notch providing transverse faces at right angles to the direction of projection of said blocks receiving one face of a corner framing in abutting relationship, and further providing tenons on one side of each block extending along and abutting the other face of said corner framing, with the tenons of one series of blocks projecting perpendicularly relative to the tenons of said other series of blocks; and d. fastener means extending through said blocks to secure said blocks in position.

15. The structure of claim 14 wherein vertically aligned passages are provided in each series of blocks and said fastener means comprises vertically extending, threaded rods extending up through said openings, and means carried by said rods for exerting a compressive force binding said series of blocks in assembled relation.

16. The structure of claim 15 wherein said passages are provided in said tenons, and the portions of the blocks in the other series of blocks underlying said tenons.

17. The structure of claim 14 wherein said tenons are secured to said framing faces by said fastener means.

* * * * *

UNITED STATES PATENT AND TRADEMARK OFFICE

CERTIFICATE OF CORRECTION

PATENT NO. : 4,967,526

DATED : November 6, 1990

INVENTOR(S) : Timothy Yost

It is certified that error appears in the above-identified patent and that said Letters Patent is hereby corrected as shown below:

In the abstract, bridging lines 5 and 6, "with the inner ends of said first and second series of blocks" should be cancelled.

Signed and Sealed this

Twenty-sixth Day of May, 1992

*Attest:*

DOUGLAS B. COMER

*Attesting Officer*

*Acting Commissioner of Patents and Trademarks*